US012433431B1

(12) United States Patent
Bryan et al.

(10) Patent No.: US 12,433,431 B1
(45) Date of Patent: Oct. 7, 2025

(54) FABRIC FOR REGULATING A TEMPERATURE OF AN ADJACENT SURFACE

(71) Applicants: David A. Bryan, Pompano Beach, FL (US); Preston A. Bryan, II, Pompano Beach, FL (US)

(72) Inventors: David A. Bryan, Pompano Beach, FL (US); Preston A. Bryan, II, Pompano Beach, FL (US)

( * ) Notice: Subject to any disclaimer, the term of this patent is extended or adjusted under 35 U.S.C. 154(b) by 106 days.

(21) Appl. No.: 18/404,326

(22) Filed: Jan. 4, 2024

(51) Int. Cl.
*A47G 9/02* (2006.01)
*A47G 9/00* (2006.01)

(52) U.S. Cl.
CPC ..... *A47G 9/0215* (2013.01); *A47G 9/0223* (2013.01); *A47G 9/0207* (2013.01); *A47G 2400/10* (2013.01)

(58) Field of Classification Search
CPC .. A47G 9/0215; A47G 9/0207; A47G 9/0223; A47G 9/0238; A47G 9/02; A47G 2400/10
USPC ..... 5/482, 495, 499, 500, 502
See application file for complete search history.

(56) References Cited

U.S. PATENT DOCUMENTS 3,027,573 A * 4/1962 Bell, Jr. ..... A47C 27/22 5/500
6,745,419 B1 * 6/2004 Delfs ..... A47G 9/0207 5/691
6,883,193 B2 * 4/2005 Brooks ..... A47G 9/0246 5/497
8,549,682 B2 * 10/2013 Low ..... A47G 9/0261 5/501
8,978,178 B2 * 3/2015 Batiste ..... A61F 7/106 5/636
10,876,234 B2 * 12/2020 Herrlich ..... D04H 1/72
10,900,156 B2 * 1/2021 Grynaeus ..... A47G 9/02
10,959,549 B2 * 3/2021 Rogers ..... B32B 5/06
11,066,764 B2 * 7/2021 Alletto, Jr. ..... D04B 1/123
11,751,698 B2 * 9/2023 Wootten, Jr. ..... A47G 9/0253 5/737
11,793,322 B2 * 10/2023 Pearce ..... A47C 27/086
12,108,899 B2 * 10/2024 Rogers ..... D05B 93/00
(Continued)

FOREIGN PATENT DOCUMENTS

AU 2020200278 A1 * 2/2020 ..... A47C 31/001
AU 2020200278 B2 * 2/2022 ..... A47C 27/086
(Continued)

*Primary Examiner* — Robert G Santos
(74) *Attorney, Agent, or Firm* — John Rizvi; John Rizvi, P.A.—The Patent Professor®

(57) ABSTRACT

A fabric for regulating temperature of an adjacent surface comprises at least one layer, for instance, a first layer, a second layer, and a third layer. At least one of the layers is comprised of a first material which comprises copper and phase change material for providing strength and structure to the fabric. At least one of the layers also comprises a cooling material, a heating material and/or a temperature-regulating material. A plurality of stitches comprising yarn can run throughout the layers, holding them together. The fabric can be used in a mattress, pillow, furniture item, garment or other item designed to be placed adjacent a user's body. When used in a mattress or pillow, the fabric may improve a person's sleep and in turn daily functioning.

20 Claims, 5 Drawing Sheets

(56) References Cited

U.S. PATENT DOCUMENTS

| | | | | |
|---|---|---|---|---|
| 2004/0172754 | A1* | 9/2004 | Brooks | A47C 27/002 5/737 |
| 2011/0283453 | A1* | 11/2011 | Low | A47G 9/0261 5/501 |
| 2012/0227185 | A1* | 9/2012 | Batiste | A47G 9/0215 5/490 |
| 2013/0115841 | A1* | 5/2013 | Ronner | D06C 15/02 28/165 |
| 2015/0201765 | A1* | 7/2015 | Batiste | A47G 9/0215 5/636 |
| 2016/0355958 | A1* | 12/2016 | Grynaeus | D04H 1/00 |
| 2017/0251825 | A1* | 9/2017 | Pearce | A47C 27/14 |
| 2018/0230630 | A1* | 8/2018 | Herrlich | D04H 1/02 |
| 2019/0014916 | A1* | 1/2019 | Wootten, Jr. | A47G 9/02 |
| 2019/0017200 | A1* | 1/2019 | Alletto, Jr. | D02G 3/40 |
| 2020/0037792 | A1* | 2/2020 | Rogers | B32B 37/12 |
| 2021/0177169 | A1* | 6/2021 | Rogers | D05B 93/00 |

FOREIGN PATENT DOCUMENTS

| | | | | | |
|---|---|---|---|---|---|
| AU | 2024202060 | A1 | * | 5/2024 | A47C 31/105 |
| CA | 2329701 | A1 | * | 6/2001 | A47C 31/105 |
| CA | 2329699 | C | * | 8/2006 | A47C 31/105 |
| CA | 3016700 | A1 | * | 9/2017 | A47C 27/002 |
| CA | 3069957 | A1 | * | 1/2019 | D02G 3/40 |
| CA | 2940026 | C | * | 9/2019 | A47G 9/02 |
| CA | 3106978 | A1 | * | 2/2020 | A47G 9/062 |
| CA | 2993887 | C | * | 10/2020 | D04H 1/732 |
| CA | 3016700 | C | * | 10/2020 | A47C 27/086 |
| CN | 105992843 | A | * | 10/2016 | A47G 9/02 |
| CN | 107923091 | A | * | 4/2018 | D04H 1/00 |
| CN | 105992843 | B | * | 3/2020 | D04H 1/54 |
| CN | 107923091 | B | * | 2/2021 | D04H 1/732 |
| DE | 102014002060 | A1 | * | 8/2015 | D04H 1/54 |
| DE | 102014002060 | B4 | * | 1/2018 | A47G 9/02 |
| DE | 202016008648 | U1 | * | 10/2018 | D04H 1/00 |
| EP | 1114598 | A2 | * | 7/2001 | A47C 31/105 |
| EP | 3133196 | A1 | * | 2/2017 | D04H 1/732 |
| EP | 3164535 | B1 | * | 8/2018 | D04H 1/54 |
| EP | 3133196 | B1 | * | 10/2020 | D04H 1/732 |
| EP | 3829402 | B1 | * | 4/2023 | B32B 5/06 |
| EP | 3652370 | B1 | * | 2/2024 | A47C 31/105 |
| EP | 3426102 | B1 | * | 9/2024 | B68G 7/00 |
| ES | 2689082 | T3 | * | 11/2018 | A47G 9/02 |
| JP | 2017505862 | A | * | 2/2017 | D04H 1/4266 |
| JP | 6374032 | B2 | * | 8/2018 | D04H 1/4266 |
| JP | 2019507640 | A | * | 3/2019 | A47C 27/086 |
| JP | 2021058650 | A | * | 4/2021 | A47C 27/086 |
| JP | 7656420 | B2 | * | 4/2025 | B68G 7/00 |
| KR | 20180128925 | A | * | 12/2018 | A47C 31/001 |
| KR | 102124152 | B1 | * | 6/2020 | A47C 27/086 |
| RU | 2668755 | C2 | * | 10/2018 | D04H 1/02 |
| RU | 2673762 | C1 | * | 11/2018 | D04H 1/72 |
| WO | WO-2015124548 | A1 | * | 8/2015 | D04H 1/70 |
| WO | WO-2017029191 | A1 | * | 2/2017 | D04H 1/42 |
| WO | WO-2017155819 | A1 | * | 9/2017 | A47C 27/085 |
| WO | WO-2019014461 | A1 | * | 1/2019 | D02G 3/40 |
| WO | WO-2020028685 | A1 | * | 2/2020 | D05B 93/00 |

* cited by examiner

FABRIC FOR REGULATING A TEMPERATURE OF AN ADJACENT SURFACE

FIELD OF THE INVENTION

The present invention relates generally to fabrics, and more specifically, to layered fabrics.

BACKGROUND OF THE INVENTION

Proper sleep is a basic necessity for normal daily functioning. However, in order for sleep to be proper, it must last an adequate number of hours and allow for the development of a series of sleep stages. An adult person should sleep uninterruptedly for 7-9 hours and progress through a first or drifting stage, a second stage in which brain wave activity increases and becomes rhythmic, heart rate decreases and body temperature drops, a transition or third stage, a fourth stage or delta sleep, and a fifth stage or rapid eye movement (REM) sleep. Children require even more sleep for proper physical and mental development, with newborns requiring up to 17 hours per day, toddlers requiring 11-14 hours per day, and school age children requiring 9-12 hours per day per the Centers for Disease Control and Prevention.

Improper or inadequate sleep can be extremely detrimental for a person's mental and physical health. Particularly, sleep deprivation, characterized by insufficient sleeping hours, and sleep fragmentation, characterized by sleep interruption causing sleep stages to start over, contribute to slow reactions, slow thinking, decreased memory, lower energy levels, mood swings, a reduction of the ability to carry out dangerous tasks such as driving or operating machinery or power tools, a significant increase in the risk of falling asleep while carrying any action including said dangerous tasks, etc. This can impede performance at work and at school, and can affect relationships due to emotional dysregulation and potential poor choices due to slow thinking and exhaustion. If sustained over a long period of time, insufficient sleep duration and/or sleep quality may also raise the risk of suffering serious diseases or medical conditions such as heart disease, excess weight, diabetes, a weakened immune system, tumor growth, high blood pressure, etc.

A significant number of technological advancements have been developed throughout time which are directed to increasing the quality and duration of sleep. Some of these efforts to improve sleep involve a variety of solutions targeted at properly positioning of the human body while sleeping. For example, new materials such as memory foam, which has the ability to shape and conform to the user's body contour while maintaining proper alignment of the neck and spine, have been developed and are used to construct both mattresses and pillows. Other efforts have been directed to allowing the user to select the softness or durability of a mattress along a length thereof, and along two halves of the mattress.

Many people, however, still do not get sufficient sleep. One reason is that the surface on which they rest their body (whether it be the mattress or pillow) is either too hot or too cold. If too hot, the user's body will sweat to counteract the heat and control body temperature; if too cold, the user's body may not be able to sufficiently warm up in opposition to the cold surface, and the user may feel cold. Sleeping on surfaces which are too hot or too cold thus creates situations such as tossing and turning, or flipping the pillow over multiple times during the night, which in turn makes for sleep deprivation and inability to function throughout the day. Additionally, due to body temperature, an individual's body may heat the surface on which they are resting their body, causing discomfort to increase throughout the night, further impeding a full night's sleep.

Currently, pillows and mattresses do not improve sleep by regulating temperature. Furthermore, many homes and buildings do not have good central heating or cooling. In addition to tossing and turning, or flipping a pillow, a person may wake up in the middle of the night to remove or pull on blankets. He or she may also get up to turn a fan or an AC unit on or off. This constant restlessness may lead to serious sleep deprivation or fragmentation. As mentioned heretofore, either one of these conditions can have serious effects on the person's health and well-being.

It is thus an aim of the present invention to address at least one of the above issues. In other words, there is a need for a solution that provides a sleeping surface which can remain at an adequate temperature that is neither too hot nor too cold, and thus allows for comfortable and restful sleeping thereon.

SUMMARY OF THE INVENTION

Introducing a first embodiment of the invention, the present invention is directed to a material structure. The material structure comprises a first layer, a second layer, and a third layer. The first layer may comprise a copper ion infused yarn and a phase change material infused yarn, the second layer may comprise spandex, and the third layer may comprise polyester.

In an aspect, the three layers may be stitched together in a diamond-shaped configuration.

In another aspect, the first layer may be comprised of about 30-55% copper ion infused yarn.

In another aspect, copper ion may be infused into about 30-55% of the yarns of the fabric.

In another aspect, phase change material may be infused into about 30-55% of the yarns of the fabric.

In another aspect, the material structure may be a temperature regulating structure.

In a second embodiment, the present invention is directed to a fabric, comprising a top layer, a middle layer, and a bottom layer, wherein the top layer may comprise copper ion infused yarns and phase change material infused yarns, wherein the middle layer may comprise a spandex fill, and wherein the bottom layer may comprise a polyester material. The top, middle, and bottom layers may be stitched together in a diamond-shaped configuration.

In an aspect, the spandex fill may further comprise a fibrous cotton material.

In another aspect, the spandex fill may still further comprise a polyester filling.

In still another aspect, the spandex fill may further comprise a wool wadding.

In another aspect, the spandex fill may further comprise a cotton material.

In still another aspect, the spandex fill may further comprise a rayon material.

In another aspect, the fabric comprising a top layer, a middle layer, and a bottom layer may comprise a form of bedding.

In another aspect, the form of bedding may be a mattress, a comforter, a quilt, a bedspread, a sheet, a blanket, a pillow, a pillowcase, a duvet, or a duvet cover.

In a third embodiment, a method of making a material structure, comprising layering together three layers of fabric, wherein the fabric may comprise a top layer, a middle layers, and a bottom layer. The top layer may comprise copper on infused yarns and phase change material infused yarns. The middle layer may comprise a fill. The bottom layer may comprise a backing. The three layers may be stitched together, and the stitching may be in a diamond shaped configuration.

In another aspect, copper ion infused yarns and phase change material infused yarns may be interwoven to form the top layer.

In another aspect, about 30-55% of the top layer of fabric may be copper-ion infused yarns.

In still another aspect, about 30-55% of the top layer of fabric may be phase-change material infused yarns.

In another aspect, the stitching of the three layers may be configured to define a raised non-stitched central portion of the diamond shaped configuration.

In another aspect, the method of making the material structure further comprises regulating the temperature of an adjacent surface.

In still another aspect, the adjacent surface may be a user's body.

In another aspect, the fabric can include a technical cooling fabric (e.g., Coolmax®, Coolcore®), a cooling yarn, organic cotton or combinations thereof.

In another aspect, spaces can be formed within the regular repeating pattern.

The term about may be defined as +/−10% of any range endpoint.

The term "stitch," may be defined according to its ordinary meaning in the art, and may also comprise "weave" or "sew".

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
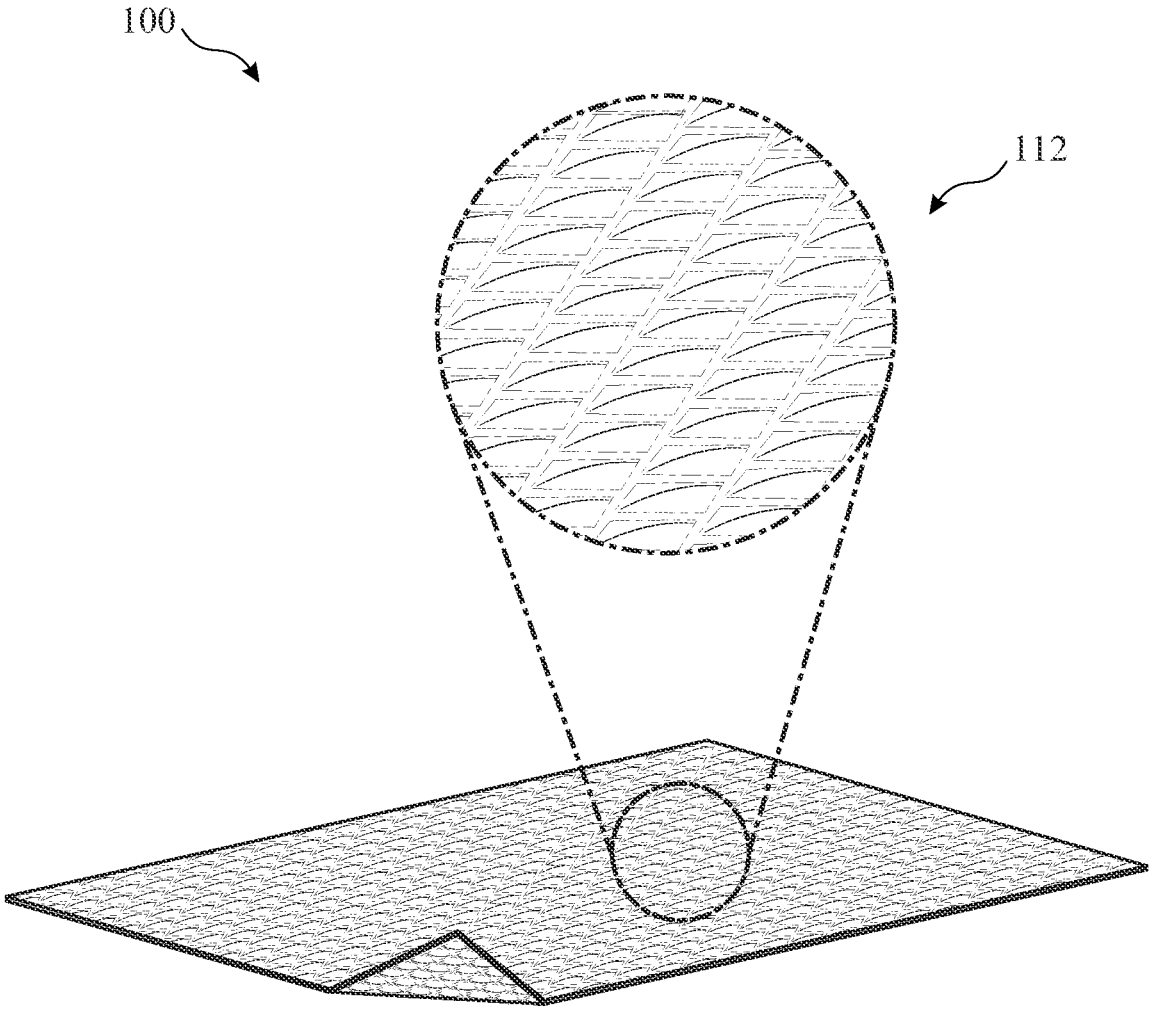
FIG. 1 presents a top isometric view of a fabric in accordance with an illustrative embodiment of the present invention, the fabric including three layers.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention refers to a material structure. The fabric is characterized in that it has three distinct layers of fabric, and in that the first layer includes both copper ion infused yarns and phase change material infused yarns. The material structure is further characterized by a second layer which serves as a spandex based fill and a third layer comprising polyester. The three layers are stitched together to make one cohesive material structure.

Copper is an anti-microbial agent. Scientific literature suggests that copper affects microbes at the cellular level. Thusly, copper ions incorporated into the yarns within the first layer of the present material structure may provide the resulting material structure with anti-bacterial, anti-fungal, and anti-viral properties and with the ability to prevent odor. Furthermore, copper is known to enhance wound healing. The copper ions may also provide strength and structure to the fabric. The copper may also be attached to a magnetic therapy device which emits a frequency that creates an electromagnetic field within the copper.

Phase change materials are able to absorb and release heat. Phase change materials are also resilient, being able to absorb and release heat multiple times, and phase change materials are available for use at different melt points. This makes phase change materials ideal for including in materials that need to withstand temperature variations, or for materials that are used for the purposes of heating and cooling either objects or individuals. Phase change materials infused into the yarns of the topmost layer of the present invention give the material structure the ability to absorb and release heat from a user.

Although the three layers may be stitched together in either a non-patterned or a patterned manner, in a preferred embodiment of the present invention, the three layers are stitched together in a diamond-shaped configuration. A diamond-shaped configuration allows for not just for structural integrity of the material structure as a whole, but also for maximum contact with an adjacent surface. This diamond-shaped characteristic of the stitching in combination with the use of both copper ion infused yarns and phase change material infused yarns gives the material structure the properties of being able to regulate temperature and exert anti-microbial effects maximally, as the copper ions and phase change material must be in contact with a surface to exert their effects on that surface.

The diamond-shaped configuration of the stitching allows for the central portion of the diamond to become raised, resulting in increased surface area contact with a surface. If the surface, is for instance, an object, the increased surface area of the material fabric that comes into contact with the surface of the object is better able to exert the anti-microbial, anti-fungal, and potential wound healing benefits of the copper ion infused yarns onto the surface of the object.

Research suggests that the effectiveness of copper ion infused yarns and phase change material infused yarns is correlated with the amount present in a substance. Percentages between 30-55% of copper ion infused yarns and 30-55% of phase change material infused yarns have been found to be effective to assert beneficial effects of each. At 30-55%, copper ion infused yarns can exert anti-microbial and anti-fungal benefits and phase change material can exert temperature-regulating benefits. In certain embodiments, the present material structure comprises 30-55% copper ion infused yarns. In certain embodiments, the present material structure comprises 30-55% phase change material infused yarns.

The material structure of the present invention may be used as a temperature regulating structure as the material structure may be used in contact with a surface, the temperature of which is associated with the melt point of the phase change material that is infused into the yarns of the first layer of the structure. Thusly, the three-layered structure may provide both insulation and heat-wicking benefits.

The present invention also refers to a fabric for regulating a temperature of an adjacent surface. The fabric has a top layer, a middle layer, and a bottom layer. The top layer comprises copper ion infused yarns and phase change material infused yarns, the middle layer comprises a spandex fill, and the bottom layer comprises a polyester material which serves as a backing. The top layer is meant to be in contact with a user's skin, while the middle layer provides cushioning, and the polyester of the bottom layer serves to assist in holding the layers of fabric together by stretching. All three layers of the fabric are stitched together in a diamond-shaped configuration.

The diamond-shaped configuration of the stitching of the fabric allows for maximum surface area contact with the skin of a user. Since the spandex fill provides the fabric with a cushioned structure, the stitching allows for the centers of the diamond shapes to become raised. As a user's skin comes into contact with the fabric, the surface of the skin first makes contact with the most raised portions of the center of the diamonds. Thusly, the fabric can be used for various purposes in which skin temperature variances occur. The raised configuration allows the fabric to exert its beneficial properties onto the skin of the user optimally.

The middle layer's spandex fill is meant to provide cushioning and create a central portion of the structure to assist with the heating and cooling properties of the fabric. Thusly, the middle layer may further comprise a fibrous cotton material, a polyester filling, wool wadding, a cotton material, or a rayon material. The type of material chosen may be based on the preferred use of the fabric. For instance, cotton may be used if the fabric is meant to be more breathable and exert more cooling properties such as in warmer climates or spring or summer seasons, while wool may be used if the fabric is meant to be more insulating and exert more heating properties such as in cooler climates or autumn or winter seasons.

For instance and without limitation, the fabric can comprise a form of bedding. Use in bedding can be an ideal use of the fabric, as many individuals experience body temperature variations when trying to fall asleep and trying to stay asleep. Nighttime environmental temperatures also tend to be lower than daytime temperatures, and environmental temperatures can fall during the night and then rise at break of day. This fall and rise of temperature can make for a restless night of sleep, which can be addressed by using bedding with temperature regulating properties. Using the present fabric in a mattress allows for contact with the entire line of the body, which use in covers such as comforters, quilts, blankets, sheets, duvets, duvet covers, or bedspreads allows the user to choose how closely to wrap the covering around the body, thus customizing the level of temperature regulation to their needs. Some individuals may struggle with keeping their pillows cool enough or warm enough at night, which makes use of the temperature regulating fabric in pillows or pillowcases ideal. Thus, the fabric can be used to manufacture an outer lining of the aforementioned bedding materials, but can also be used to manufacture clothing, and an outer surface of a chair, couch or other furniture item.

Copper ion infused yarns provide the resulting fabric with anti-bacterial and anti-fungal properties and with the ability to prevent odor. The copper piece or pieces may also provide strength and structure to the fabric, which further assists when incorporating the fabric into fabrics that are used daily, such as those that are used for bedding.

The phase change material (PCM) infused into the yarns of the fabric may include but is not limited to a PCM material manufactured by Outlast® Technologies, Cygnet® and Comfortemp®. The phase change material works like a thermostat. Specifically, the PCM is set to a specific, predetermined temperature (for instance, 98.6° F.) by appropriately configuring the shape, size, quantity and/or distribution of the phase change material within the fabric; accordingly, the fabric absorbs and releases heat to keep the fabric at its predetermined temperature.

In addition to copper and PCM, any of three layers of the fabric may optionally include materials such as, but not limited to, bamboo, non-organic cotton, regenerated wool cellulose (e.g. Tencel®), polyester, rayon, cotton, nylon, satin, silk, wool, linen, spandex, cashmere, hemp, microfiber, yarn, suede, chambray, denim, flannel and ultra-high-molecular-weight polyethylene (UHMWPE) fabric. Alternatively or additionally, any of three layers of the fabric may include minerals such as limonite, silicate, ionized silicium, magnesium, calcium, tourmaline, quartz, jade, amethyst, agate, topaz, turquoise, pyrite, rhodochrosite, obsidian and turquenite.

A material structure can be made via a method of layering together three layers of fabric, wherein the method includes interweaving copper ion infused yarns and phase change material infused yarns into the first layer of the material structure. Interweaving the two types of yarns allows for the resulting first layer of the material structure to exert balanced and consistent benefits on a user of the material structure. Interweaving copper ion infused yarn in the amounts of about 30-55% of the top layer of the material structure with phase change material infused yarn in the amounts of about 30-55% allows for the anti-microbial and temperature regulating benefits to occur at the same time when in contact with the skin of a user.

FIGS. 1-5 depict a fabric in accordance with an illustrative embodiment of the invention.

Referring initially to FIG. 1, a fabric 100 is depicted with a zoomed-in view showing the stitching of the fabric. As can be seen in the preferred embodiment, the diamond shaped configuration of the stitching 112 effects the texture of the fabric, and results in a raised portion in the centers of the diamond-shaped areas of the surface of the fabric.

Figure 2:
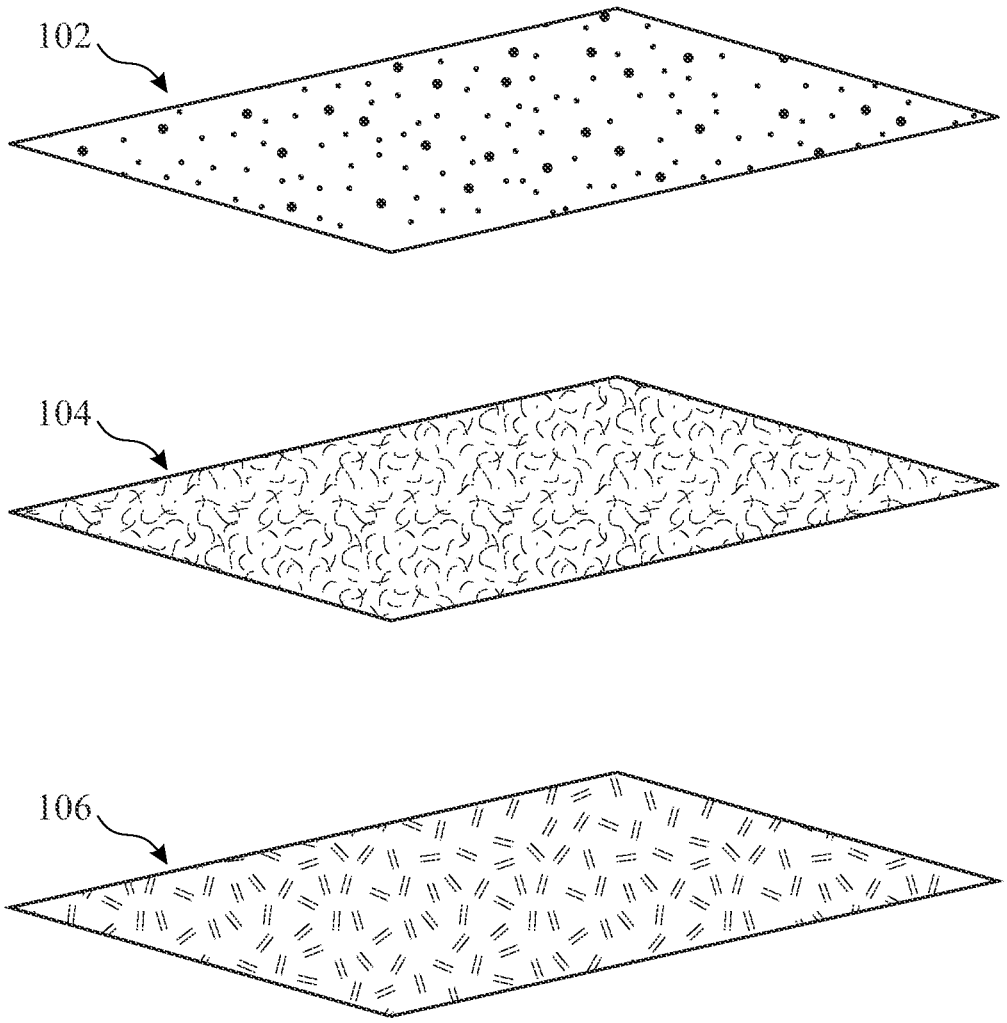
FIG. 2 presents an isometric exploded view of the fabric of the previous figure.

Referring to FIG. 2, the fabric 100 is depicted in an exploded configuration, revealing its components. As shown, the fabric 100 of the present example is formed of three layers, a first layer 102, a second layer 104, and a third layer 106. In some embodiments, the first layer 102 is an outermost layer of the fabric 100 on one side of the fabric 100; for instance, in the present embodiment, the first layer 102 is an outermost, top layer or face of the fabric 100. In some embodiments, the third layer 106 is an outermost layer of the fabric 100 on the opposite side of the fabric 100; for instance, in the present embodiment, the third layer 106 is an outermost, bottom layer or backing of the fabric 100. The second layer 104 is arranged between the first and third layers 102 and 106; for instance, the second layer 104 of the present embodiment is sandwiched directly between and in contact with the first and third layers 102 and 106.

Figure 3:
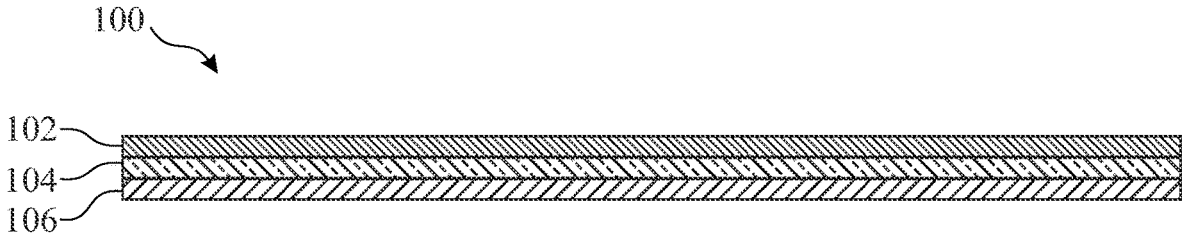
FIG. 3 presents a cross-sectional side elevation view of an illustrative application of the invention.

As shown in FIG. 3, the first, second and third layers 102, 104, and 106 are layered directly adjacent to one another. As shown in FIG. 1, the layers are held in place relative to one another by a stitching 112. The stitching 112 can extend through the second layer 104 and to the first and third layers 102 and 106. In some embodiments, more specifically, the stitching 112 can extend through all three layers 102, 104 and 106. In the present embodiment, the stitching 112 is formed by pairs of parallel yarn stitching lines, where the parallel stitching lines of each pair are arranged in a spaced-apart relationship with one another defining a non-stitched inlay or space therebetween. The stitching defines a pattern defining non-stitched areas delimited by the stitching lines. The non-stitched areas can be in varying geometric shapes, for instance, and without limitation.

Figure 4:
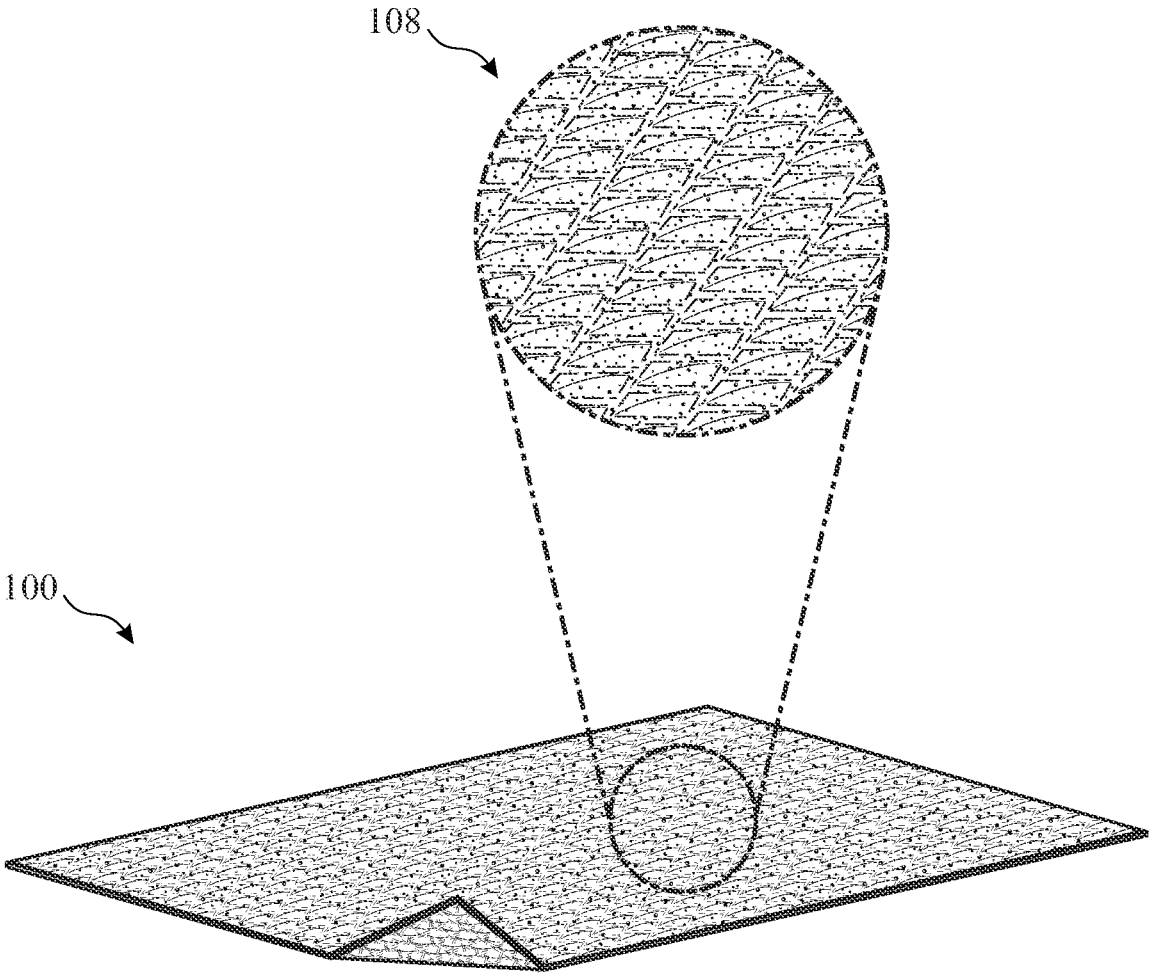
FIG. 4 presents an isometric view of the top or first layer of the fabric of FIG. 1, with a zoomed-in view of copper-ion infused yarn and phase-change material infused yarn.

The first layer 102 can include copper and a phase change material (PCM). For instance, in the present embodiment and as shown in FIG. 4, the face or first layer includes copper ion infused yarns and phase change material infused yarns interwoven together 108. Interweaving the copper ion infused yarns with the phase change material 108 infused yarns allows for the benefits of both types of yarn to be demonstrated, which is especially apparent when the fabric is in contact with the body of a user.

Figure 5:
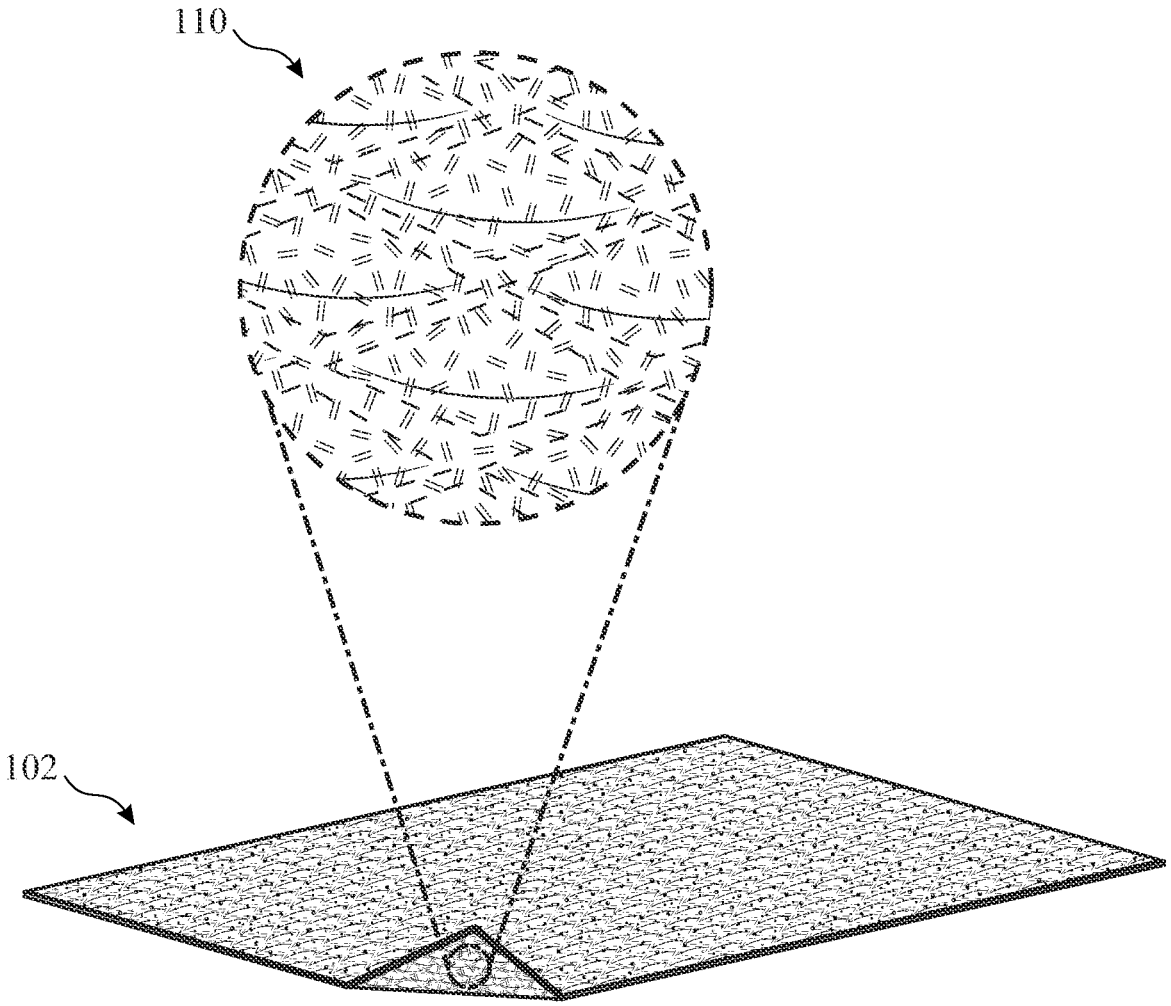
FIG. 5 presents an isometric view of the bottom or third layer of the fabric of FIG. 1, with a zoomed-in view of polyester.

The fill or second layer 104, the majority of which is comprised of spandex in order for the second layer 104 to include a cushioning material and thereby provide a cushioned fill to the fabric 100. The backing or third layer 106 of the present embodiment is comprised of polyester 110, as shown in FIG. 5. The second and third layers of the fabric contains no copper ion infused yarns or phase change material infused yarns.

While sleeping, a user's body temperature and/or the environmental temperature may increase or decrease. The PCM infused yarn comprised in the top layer of the fabric 100 may be initially solid and absorbs heat as the surrounding temperature rises. As the PCM infused yarn absorbs heat, its temperature increases with the surrounding temperature. When the PCM infused yarn reaches its phase change temperature, the PCM begins to change phase (i.e. to melt into a liquid phase). During the duration of the phase change process, the PCM material absorbs large amounts of heat while substantially maintaining its temperature. Thus, during the phase change process, the PCM infused yarn stays at its phase change temperature (98.6° F.) while the environmental or user body temperature increases. This allows the PCM infused yarn to provide a cooling sensation to the user, as the user will perceive the mattress or other bedding material as being cooler than the environment. An inverse procedure takes place when the environmental or user temperature decreases. The PCM infused yarn will release large amounts of heat while substantially maintaining its temperature equal to the phase change temperature (98.6° F.). In consequence, the PCM infused yarns will provide a warming effect by which the user will perceive the mattress or other bedding material as being cooler than the environment.

Alternative embodiments of the invention to those shown in the drawings are contemplated without departing from the scope of the present disclosure. For instance, it is possible for the fabric to be formed of any number of layers greater than or equal to three. In embodiments having more than three layers, phase change material infused yarns and copper ion infused yarns will be present in the topmost layer.

Additionally, open-cell high air-flow foam may be incorporated into the material structure or fabric. The open-cell high air-flow foam may be an innovative viscoelastic foam specifically designed to target the main weaknesses of conventional memory foam, introducing a breathable and odorless foam with dramatically improved static and dynamic fatigue properties. A new polymer design opens the cell structure, improving air flow by 95% and dissipating heat and moisture three times faster than conventional memory foam. The unique open-cell structure of the open-cell high air-flow foam improves heat flow by enabling higher conductivity and allowing heat to leave the foam through convection.

Variable support gel may also be incorporated into the material structure or fabric. The variable support gel may rapidly adapt to individual needs to support and cushion the body. Gel-infusion technology provides enhanced support in deep compression areas, where individual gel particles interact to add the pressure response characteristics of pure gel to the softness and comfort of viscoelastic foam.

Further, an enhanced thermoregulation gel may be included that incorporates the thermoregulation of phase change material into open-cell viscoelastic gel-foam technology, providing improved temperature regulation. The thermoregulation gel may maintain an optimal skin temperature of a person at 87 degrees to 90 degrees Fahrenheit (30-32 degrees Celsius) for comfortable and restful sleep. This temperature is maintained through the infinitely reversible phase change of the enhanced thermoregulation material, as it can absorb or liberate heat when it is in contact with a body having a surface temperature higher or lower than the target temperature.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A material structure, comprising:

a first layer, wherein the first layer comprises:

a copper ion infused yarn; and a phase change material infused yarn;

a second layer, wherein the second layer comprises spandex; and a third layer, wherein the third layer comprises polyester;

wherein the three layers are stitched together.

2. The material structure of claim 1, wherein the three layers are stitched together in a diamond-shaped configuration.

3. The material structure of claim 2, wherein the first layer is comprised of about 30-55% copper ion infused yarn.

4. The material structure of claim 3, wherein the first layer is comprised of about 30-55% phase change material infused yarn.

5. The material structure of claim 3, wherein the material structure is a temperature regulating structure.

6. A fabric, comprising:

a top layer, wherein the top layer comprises copper ion infused yarns and phase change material infused yarns;

a middle layer, wherein the middle layer comprises a spandex fill; and a bottom layer, wherein the bottom layer comprises a polyester material;

wherein the top, middle, and bottom layers are stitched together in a diamond-shaped configuration.

7. The fabric of claim 6, wherein the spandex fill further comprises a fibrous cotton material.

8. The fabric of claim 6, wherein the spandex fill further comprises a polyester filling.

9. The fabric of claim 6, wherein the spandex fill further comprises a wool wadding.

10. The fabric of claim 6, wherein the middle layer further comprises a cotton material.

11. The fabric of claim 6, wherein the middle layer further comprises a rayon material.

12. The fabric of claim 6, wherein the fabric comprises a form of bedding.

13. The fabric of claim 10, wherein the form of bedding comprises a mattress, a comforter, a quilt, a bedspread, a sheet, a blanket, a pillow, a pillowcase, a duvet, or a duvet cover.

14. A method of making a material structure, comprising:

layering together three layers of fabric, the fabric comprising:

a top layer, wherein the top layer comprises copper ion infused yarns and phase change material infused yarns;

a middle layer, wherein the middle layer comprises a spandex fill; and a bottom layer, wherein the bottom layer comprises a polyester backing; and stitching the three layers of fabric together; wherein the stitching is in a diamond shaped configuration.

15. The method of claim 14, further comprising:

interweaving copper ion infused yarns and phase change material infused yarns to form the top layer.

16. The method of claim 15, wherein about 30-55% of the top layer of fabric is the copper ion infused yarns.

17. The method of claim 15, wherein about 30-55% of the top layer of fabric is the phase-change material infused yarns.

18. The method of claim 16, wherein the stitching together of the three layers is configured to define a raised non-stitched central portion of the diamond shaped configuration.

19. The method of claim 15, further comprising: regulating the temperature of an adjacent surface.

20. The method of claim 17, wherein the stitching together of the three layers is configured to define a raised non-stitched central portion of the diamond shaped configuration.

* * * * *